US009390868B2

(12) United States Patent
Clark

(10) Patent No.: US 9,390,868 B2
(45) Date of Patent: Jul. 12, 2016

(54) SWITCH ASSEMBLY FOR DISCONNECT OPERATOR

(71) Applicant: John Stephen Clark, South Milwaukee, WI (US)

(72) Inventor: John Stephen Clark, South Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 332 days.

(21) Appl. No.: 13/837,100

(22) Filed: Mar. 15, 2013

(65) Prior Publication Data

US 2014/0262711 A1 Sep. 18, 2014

(51) Int. Cl.

| | |
|---|---|
| ***H01H 9/22*** | (2006.01) |
| ***H01H 71/04*** | (2006.01) |
| ***H01H 9/04*** | (2006.01) |
| ***H01H 71/56*** | (2006.01) |

(52) U.S. Cl.
CPC . *H01H 9/04* (2013.01); *H01H 9/22* (2013.01); *H01H 71/04* (2013.01); *H01H 71/56* (2013.01)

(58) Field of Classification Search
CPC ..... H01H 9/22; H01H 71/04; H01H 9/281; H01H 9/283; H01H 9/282
USPC ..... 200/302.1, 302.2, 50.05, 43.14, 43.15, 200/401, 43.16, 43.11, 50.11
See application file for complete search history.

(56) References Cited

U.S. PATENT DOCUMENTS

| | | | | | |
|---|---|---|---|---|---|
| 2,306,235 | A * | 12/1942 | Walle | 337/97 | |
| 3,911,235 | A | 10/1975 | Venzke et al. | | |
| 5,817,999 | A * | 10/1998 | Mugan | H01H 9/283 | 200/43.15 |
| 6,008,458 | A * | 12/1999 | Domzalski et al. | 200/302.1 | |
| 8,519,283 | B2 * | 8/2013 | Whitaker | H01H 9/282 | 200/43.22 |
| 2012/0018286 | A1 * | 1/2012 | Knoerrchen | H01H 9/282 | 200/43.11 |
| 2013/0270076 | A1 * | 10/2013 | Linden | H01H 9/283 | 200/43.15 |

FOREIGN PATENT DOCUMENTS

| | | | |
|---|---|---|---|
| CN | 101083183 | A | 12/2007 |
| CN | 102867674 | A | 1/2013 |
| DE | 4312428 | C1 | 11/1994 |
| DE | 20313193 | U1 | 10/2003 |
| JP | 2008159503 | A | 7/2008 |

OTHER PUBLICATIONS

European Search Report, May 19, 2014; 9 pages.

* cited by examiner

*Primary Examiner* — Renee S Luebke
*Assistant Examiner* — Ahmed Saeed
(74) *Attorney, Agent, or Firm* — Quarles & Brady LLP

(57) ABSTRACT

A sealed switch assembly for use with a disconnect operator movable between an on state, a tripped state, and an off state. The disconnect operator housed within a sealed enclosure. The switch assembly includes a housing sealed to the enclosure to inhibit ingress of solids and liquids therebetween. A handle is coupled to the disconnect operator and is disposed at least partially within the housing. The handle is sealed to the housing to inhibit ingress of solids and liquids therebetween, and is moveable between an on position and an off position. A low-friction trip indicator mechanism operates independent of the handle to indicate when the disconnect operator is in the tripped state.

17 Claims, 16 Drawing Sheets

FIG. 11
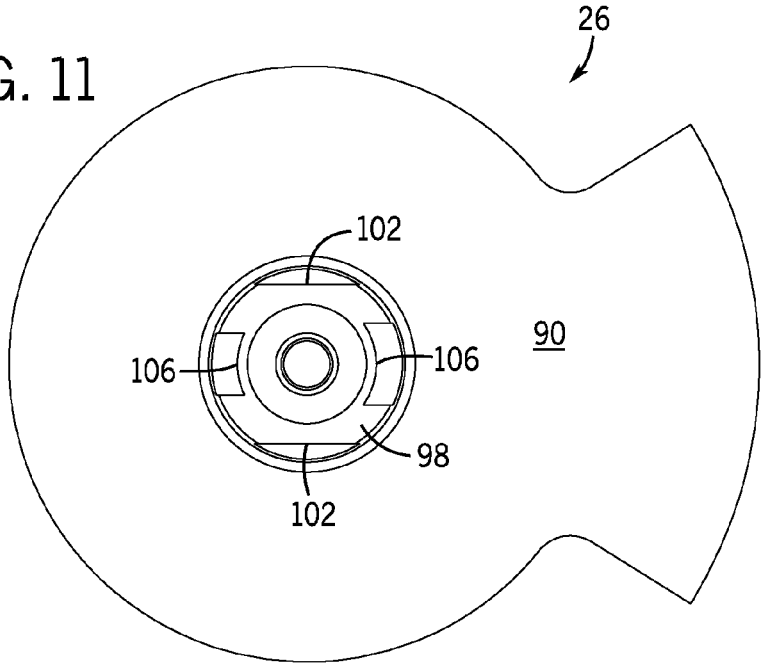
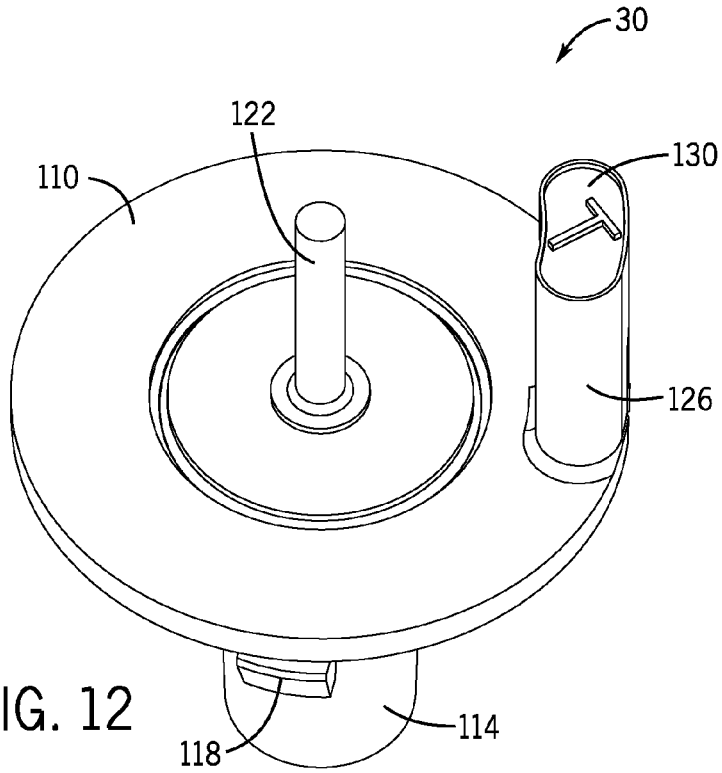
FIG. 12

FIG. 19
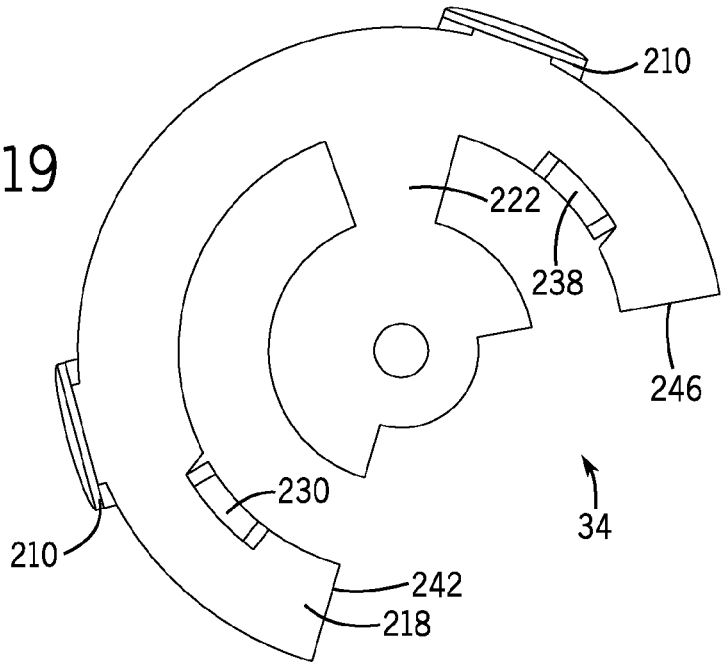
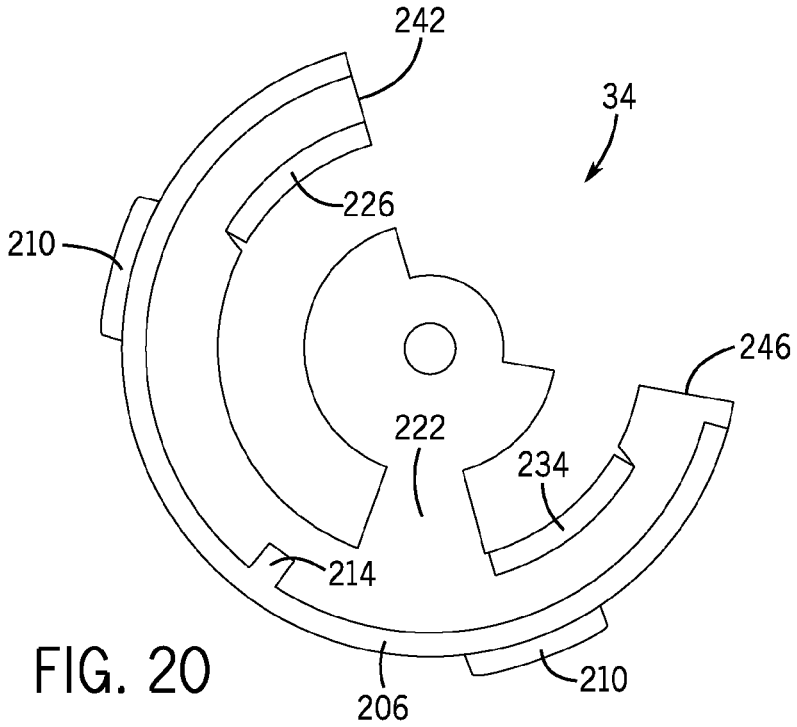
FIG. 20

FIG. 21
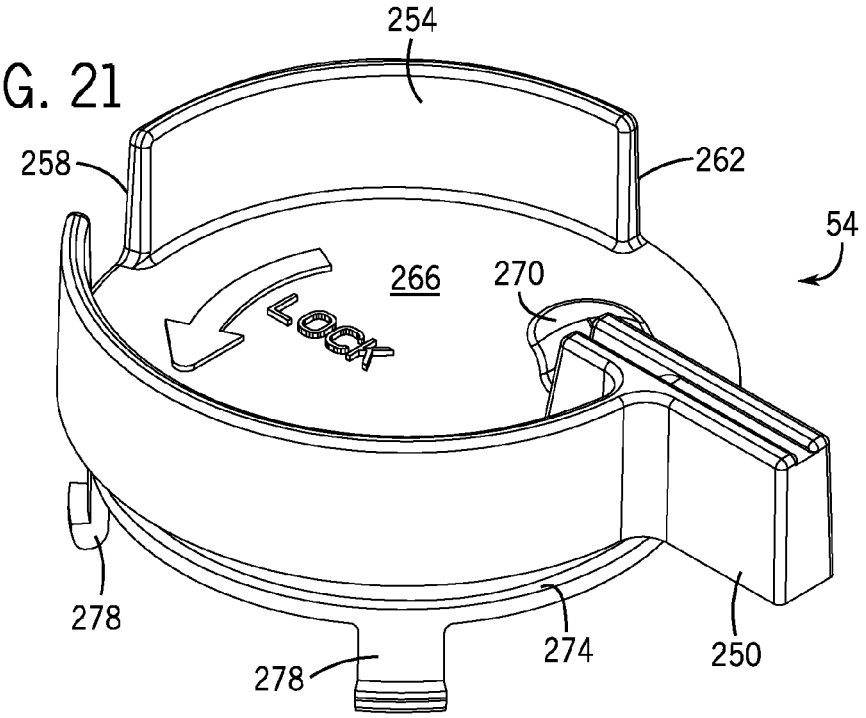
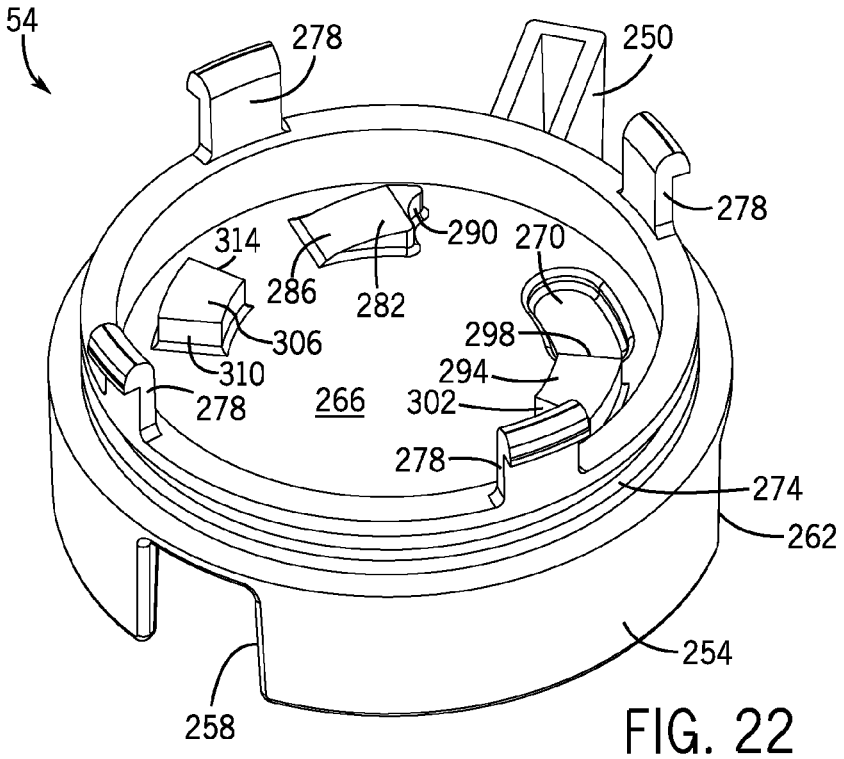
FIG. 22

SWITCH ASSEMBLY FOR DISCONNECT OPERATOR

BACKGROUND

The present invention is directed to disconnect operators. In particular the invention is directed to water resistant actuators or switches for disconnect operators.

In industrial environments, electrical enclosures and related components need to meet various standards based on the environment the electrical enclosure will be subjected to. For example, an enclosure may be required to meet the UL50 type 4/IP67/IP69K standard. The UL50 type 4/IP67/IP69K standard provides strict guidelines within a rated device must function. The guidelines provide standards for ingress of solids and liquids. As a result, a UL50 type 4/IP67/IP69K rated device must meet a defined threshold or standard for repelling environmental conditions. Such a threshold or standard provides a challenge in adapting standard devices to meet the UL50 type 4/IP67/IP69K standard.

Typical switch assemblies for disconnect operators include high friction, heavy duty o-rings or K-seals. These high friction seals provide the necessary rating for resistance to environmental ingress, but the switches are difficult to actuate. As a result, when an associated disconnect operator actuates to a tripped state, the switch assembly may resist the movement. Often, this problem is overcome by utilizing sealing grease or providing spring bias toward a tripped position. Typically, a handle of the switch assembly serves as the indicator of a tripped state.

BRIEF SUMMARY OF THE INVENTION

The present embodiments overcome the aforementioned problems by providing a switch assembly for a disconnect operator that is easy to assemble and that meets the UL50 type 4/IP67/IP69K standard while providing a low friction tripped state indicator.

In one construction, the invention provides a sealed switch assembly for use with a disconnect operator movable between an on state, a tripped state, and an off state. The disconnect operator housed within a sealed enclosure. The switch assembly includes a housing sealed to the enclosure to inhibit ingress of solids and liquids therebetween. A handle is coupled to the disconnect operator and is disposed at least partially within the housing. The handle is sealed to the housing to inhibit ingress of solids and liquids therebetween, and is moveable between an on position and an off position. A low-friction trip indicator mechanism operates independent of the handle to indicate when the disconnect operator is in the tripped state.

In another construction, the invention provides a UL50 type 4/IP67/IP69K rated switch assembly for use with a disconnect operator that is movable between an on state, a tripped state, and an off state. The disconnect operator is housed within a sealed enclosure. The switch assembly includes a handle that is coupled to the disconnect operator and is movable between an on position and an off position. An indicator indicates when the disconnect operator is in the tripped state, and a latching mechanism is coupled between the handle and the disconnect operator such that when the disconnect operator actuates from the on state to the tripped state, the handle does not move.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

FIG. 11 is a top view of the disconnect handle shaft of FIG. 8.

FIG. 12 is a top perspective view of a reset flag of the switch assembly of FIG. 1.

FIG. 19 is a bottom view of the cam element of FIG. 18.

FIG. 20 is a top view of the cam element of FIG. 18.

FIG. 21 is a top perspective view of a handle of the switch assembly of FIG. 1.

FIG. 22 is a bottom perspective view of the handle of FIG. 21.

Figure 1:
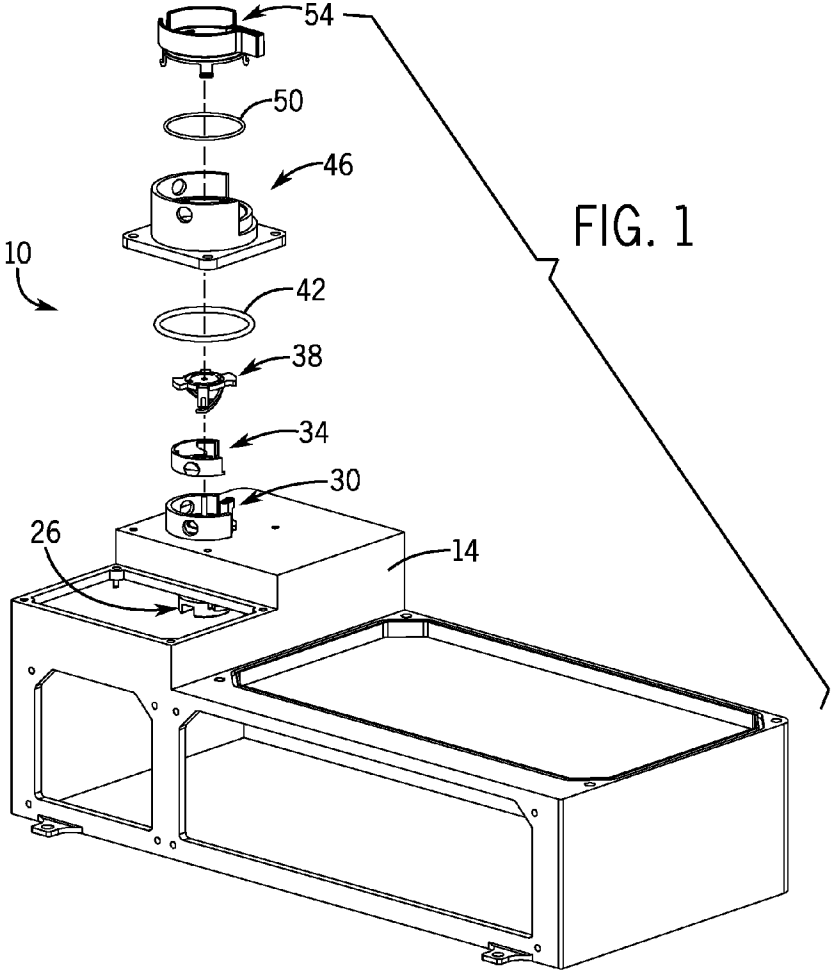
FIG. 1 is an exploded view of a switch assembly according to one embodiment of the invention installed in an enclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention will be described in terms of one or more preferred embodiments, and it should be appreciated that many equivalents, alternatives, variations, and modifications, aside from those expressly stated, are possible and within the scope of the invention.

Figure 29:
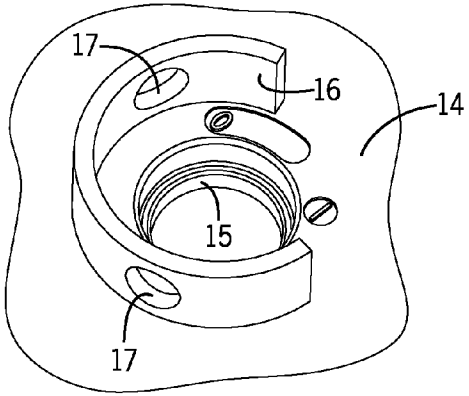
FIG. 29 is a detail view of a connection point of the enclosure of FIG. 1.
Figure 28:
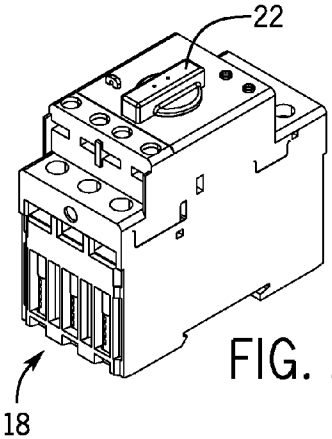
FIG. 28 is a perspective view of a disconnect operator.
Figure 3:
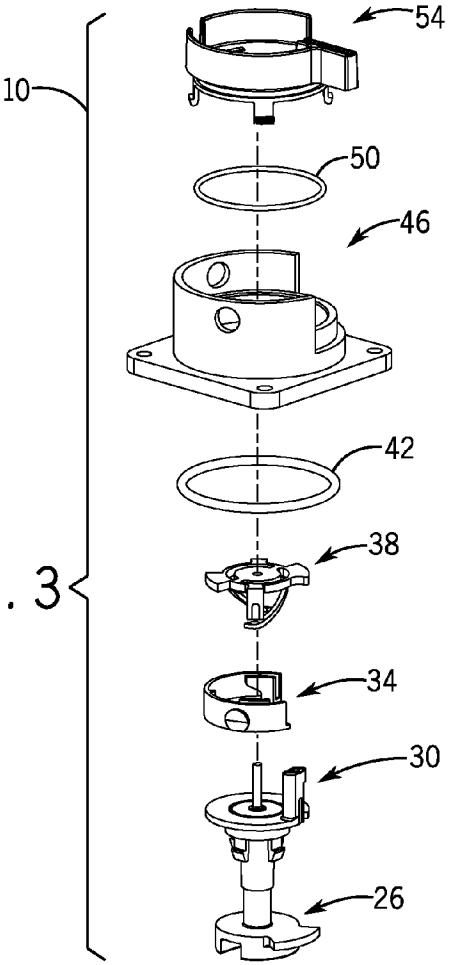
FIG. 3 is an exploded view of the switch assembly of FIG. 1.
Figure 2:
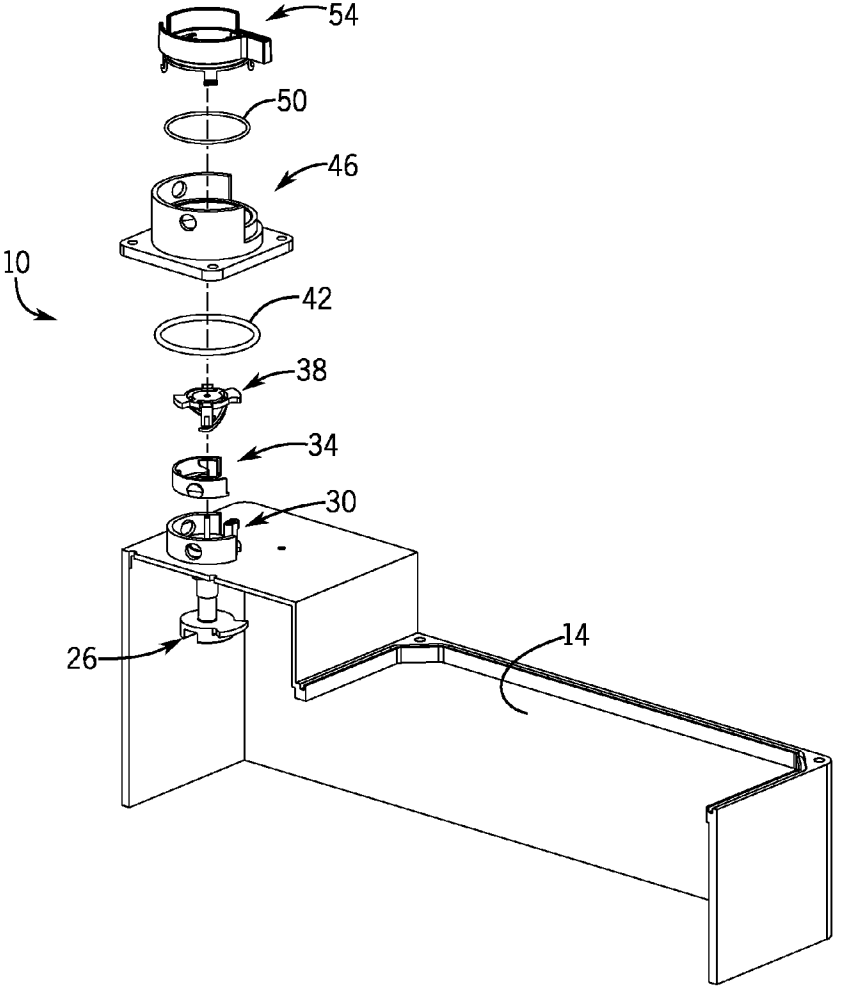
FIG. 2 is a section view of the exploded switch assembly of FIG. 1 taken along line 2-2 of FIG. 1.
Figure 4:
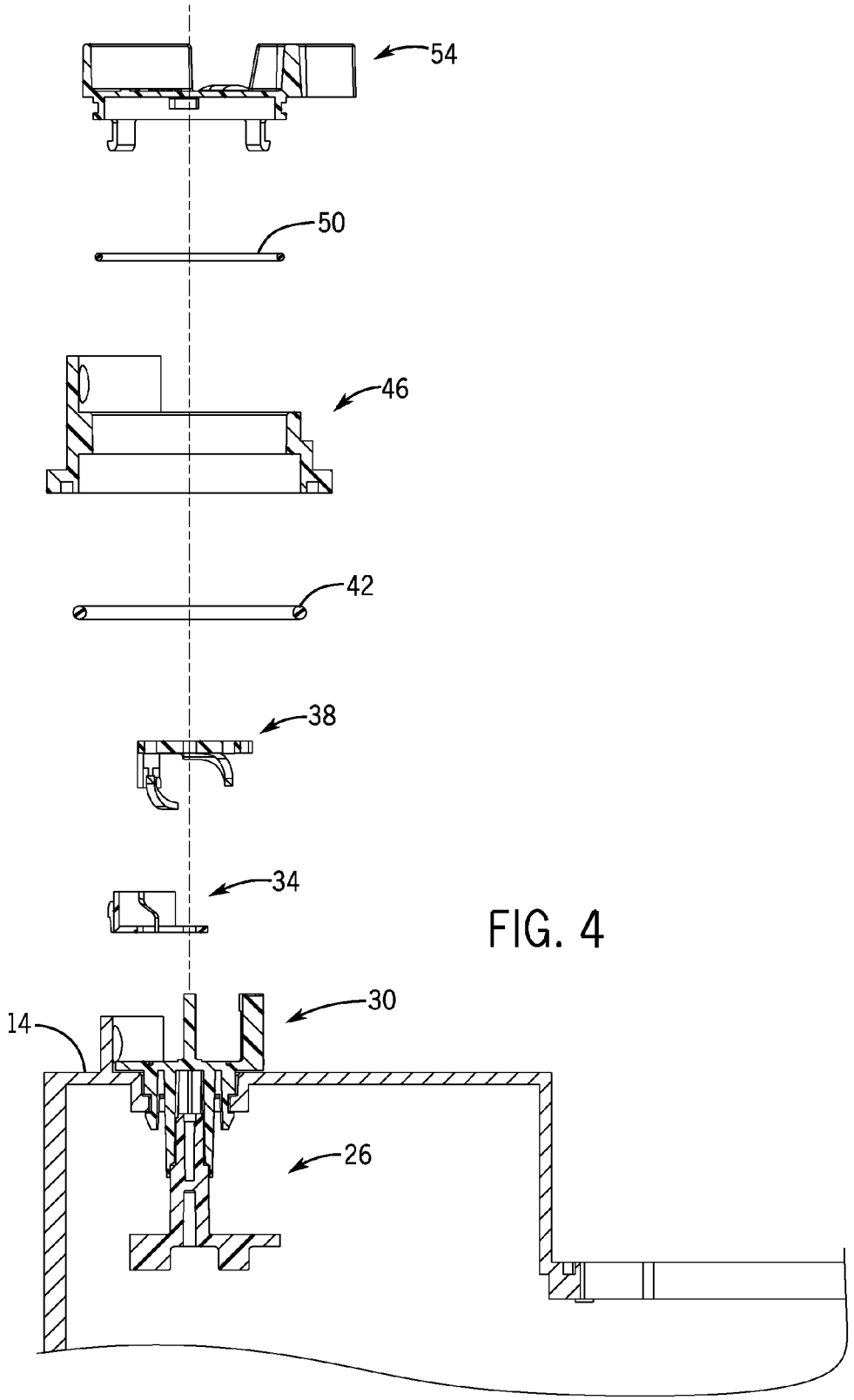
FIG. 4 is a section view of the exploded switch assembly of FIG. 1 taken along line 4-4 of FIG. 1.
Figure 5:
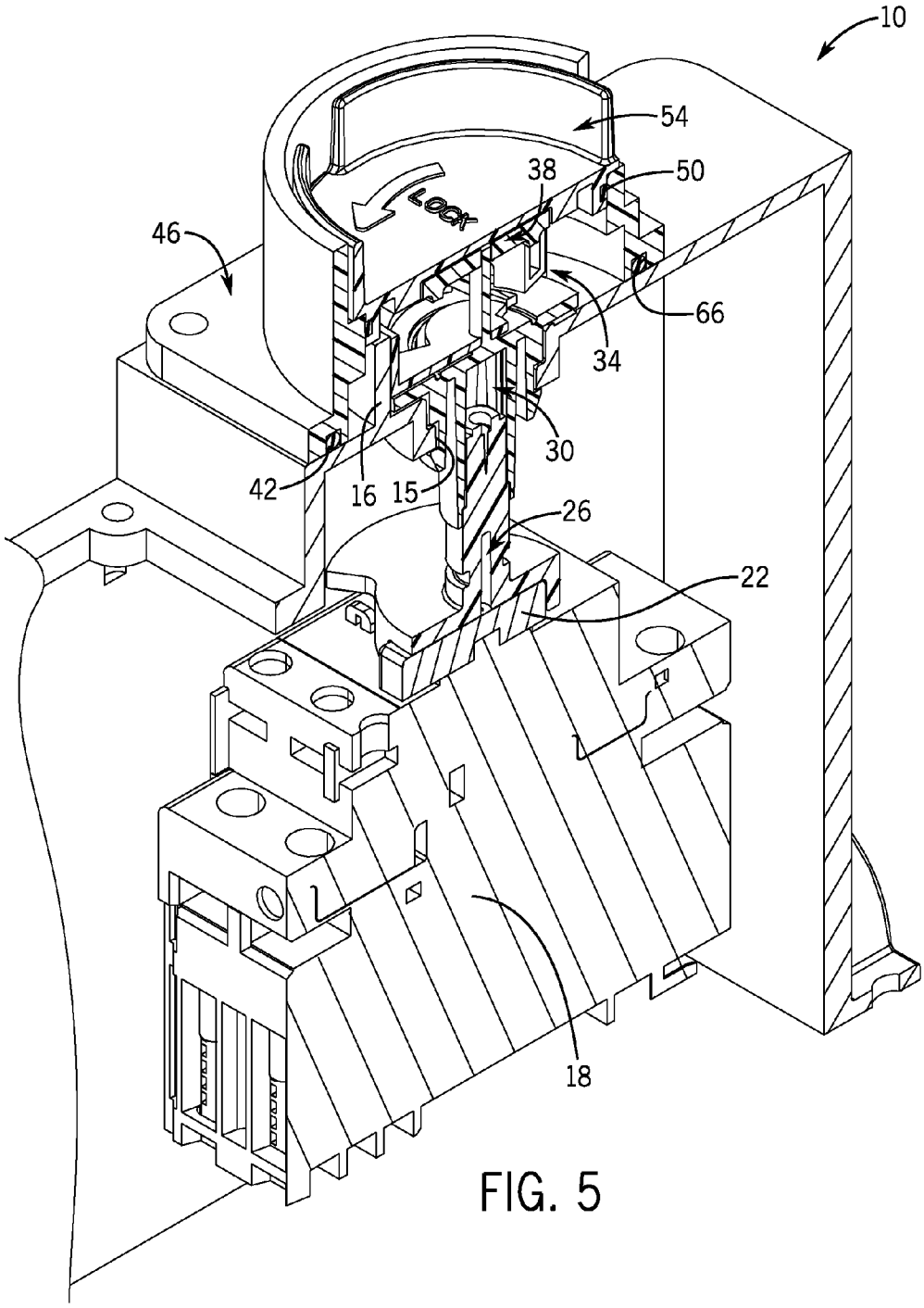
FIG. 5 is a section view of the switch assembly of FIG. 1 installed in the enclosure.
Figure 6:
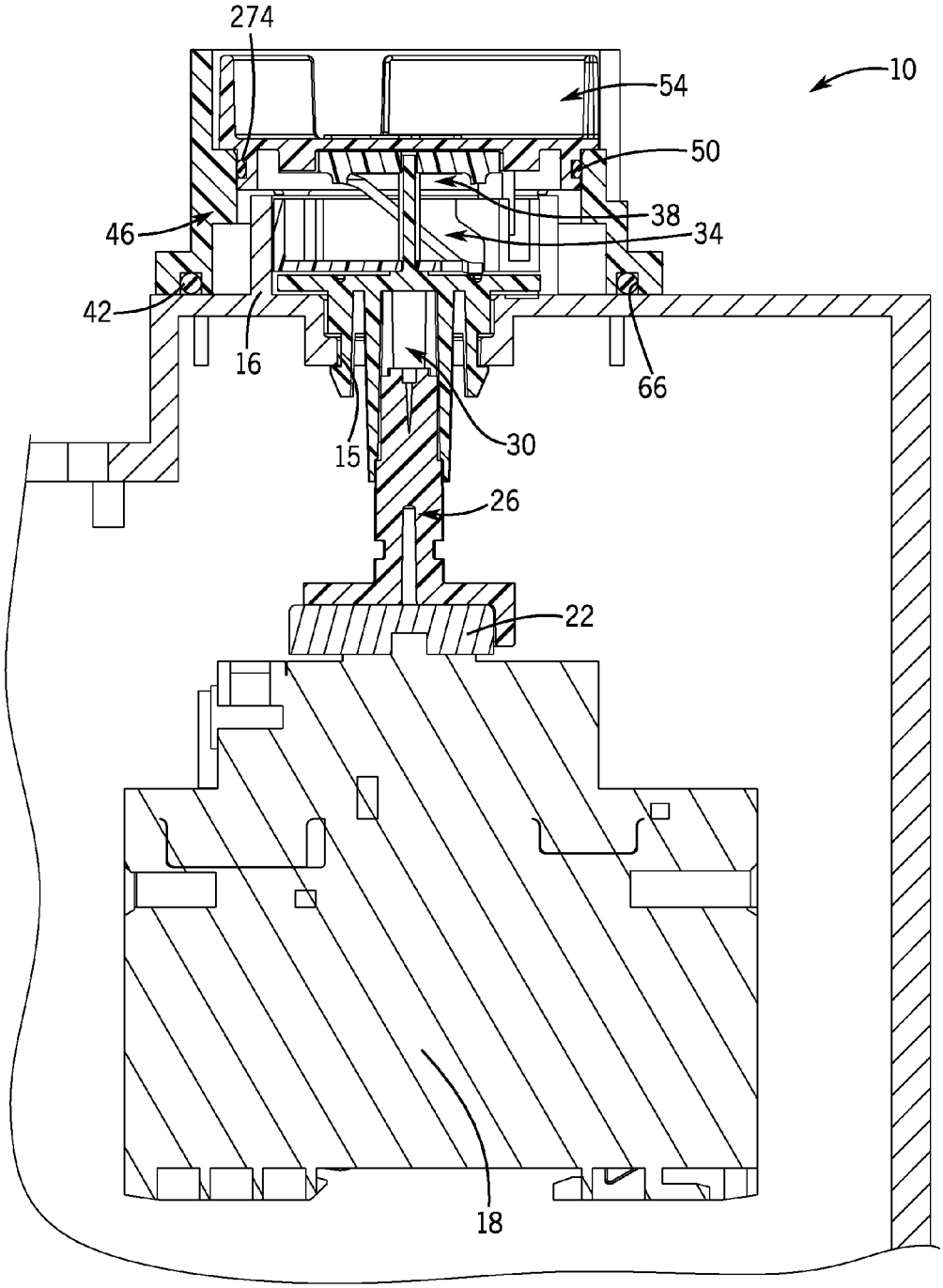
FIG. 6 is a section view of the switch assembly of FIG. 1 installed in the enclosure.

FIGS. 1 and 2 show a switch assembly 10 mounted to an enclosure 14 for operating a disconnect operator 18 located within the enclosure 14. As shown in FIG. 29, the enclosure 14 defines an aperture 15, and a wall 16 that defines two apertures 17. As shown in FIG. 28, the disconnect operator 18 includes a disconnect switch 22 that is moveable between an ON position, an OFF position, and a TRIPPED position (i.e., on state, off state, and tripped state). It is to be appreciated that a variety of devices are operable with the switch assembly 10.

Turning to FIGS. 3-6, the switch assembly 10 includes a disconnect handle shaft 26, a reset flag 30, a cam element 34, a latching mechanism 38, a base seal 42, a tagout base 46, a handle seal 50, and a handle 54.

Figure 7:
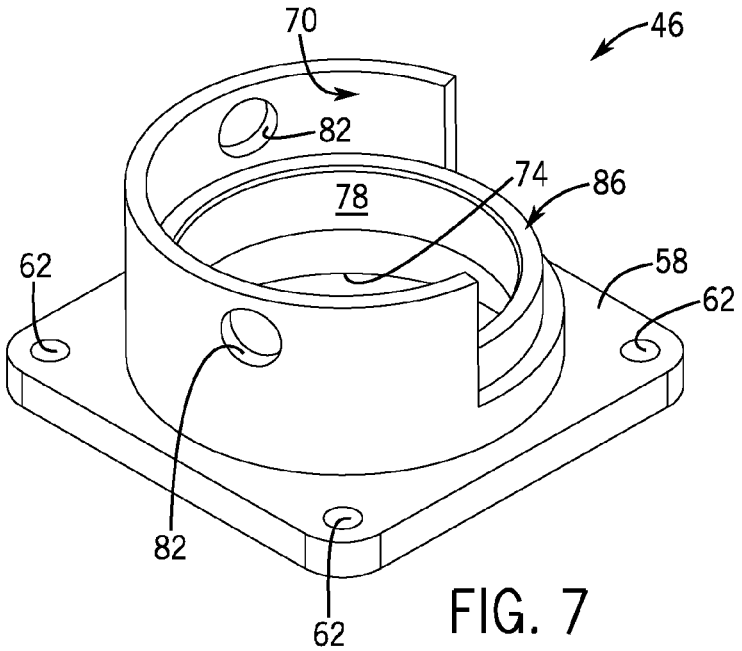
FIG. 7 is a perspective view of a tag out base of the switch assembly of FIG. 1.

With reference to FIG. 7, the tagout base 46 includes a flange 58 that defines four apertures 62 (three are visible) sized to receive fasteners for coupling the tagout base 46 to the enclosure 14 and an annular recess 66 (see FIGS. 5 and 6) sized to receive the base seal 42. The illustrated base seal 42 is an o-ring, although other seal types are contemplated. The base seal 42 provides a static seal between the tagout base 46 and the enclosure 14 to inhibit the ingress of solids and liquid into the interior of the switch assembly 10.

The tagout base 46 further defines an annular wall 70 surrounding a central aperture 74 arranged to align with the aperture 15 in the enclosure 14 when the tagout base 46 is installed on the enclosure 14. A sealing surface 78 is defined on an inner periphery of the annular wall 70 and two tagout apertures 82 are defined through the annular wall 70. A cutout section 86 is defined over about ninety degrees (90°) of the annular wall 70.

Figure 8:
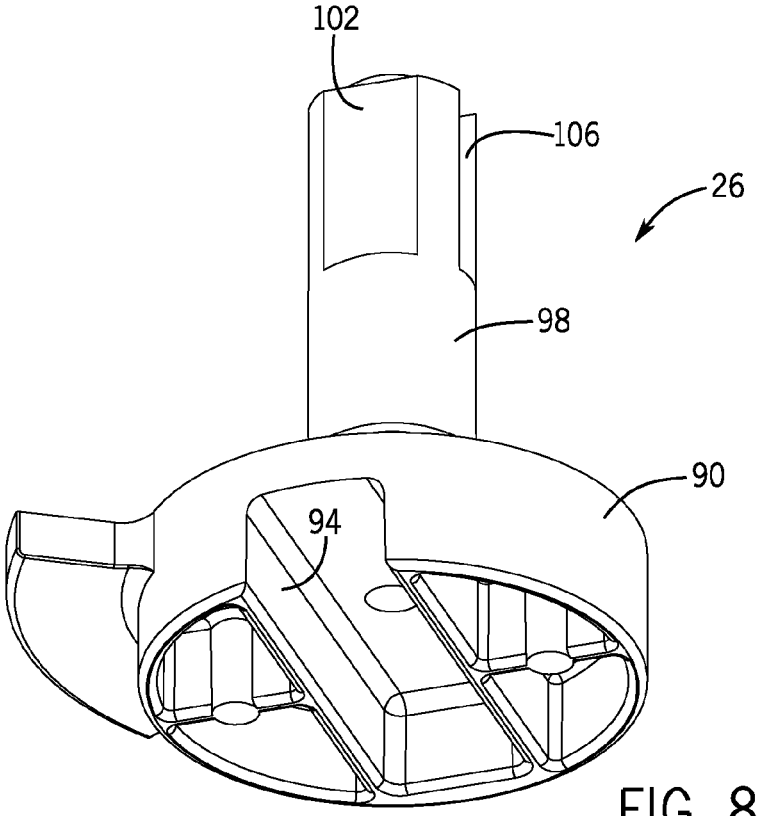
FIG. 8 is a bottom perspective view of a disconnect handle shaft of the switch assembly of FIG. 1.
Figure 10:
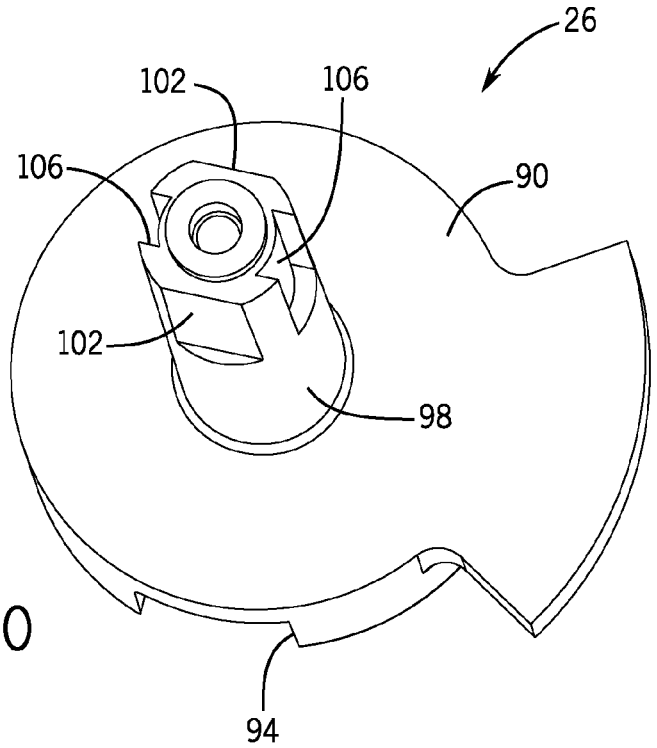
FIG. 10 is a top perspective view of the disconnect handle shaft of FIG. 8.

With reference to FIGS. 8, 10, and 11, the disconnect handle shaft 26 includes a base 90 defining a switch interface in the form of a recess 94 shaped to receive the disconnect switch 22 of the disconnect operator 18 when the switch assembly 10 is installed. A shaft 98 extends upward from the base 90 and terminates in a coupling feature in the form of two flats 102 and two keyways 106 (see FIGS. 10 and 11).

Figure 9:
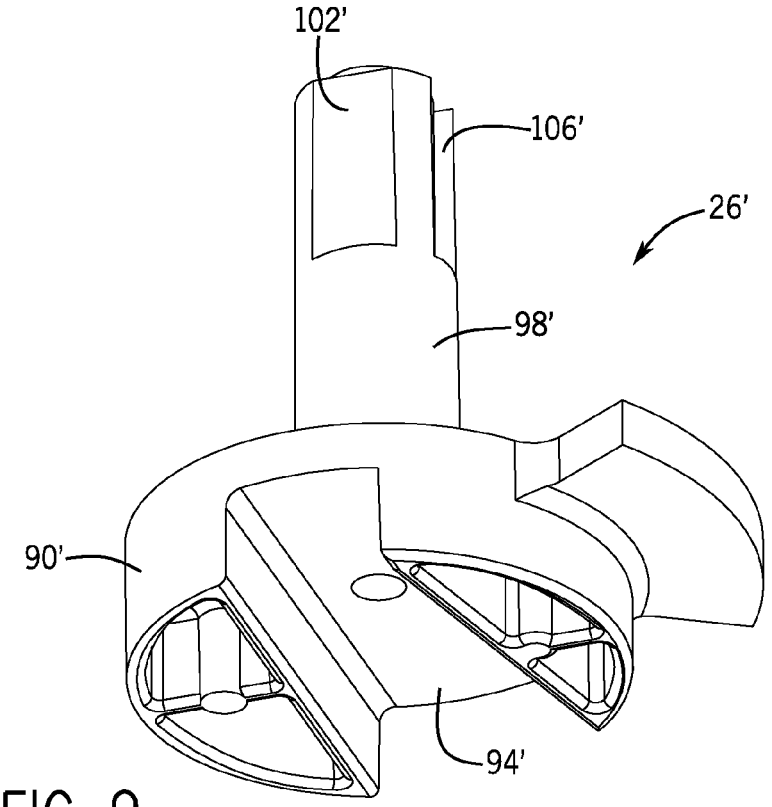
FIG. 9 is a bottom perspective view of another disconnect handle shaft.

FIG. 9 shows an alternative disconnect handle shaft 26' with similar parts to disconnect handle shaft 26 but with a differently shaped recess 94'. Other profiles and switch interface features are possible and contemplated and will depend on the particular disconnect operator 18 used with the switch assembly 10.

Figure 13:
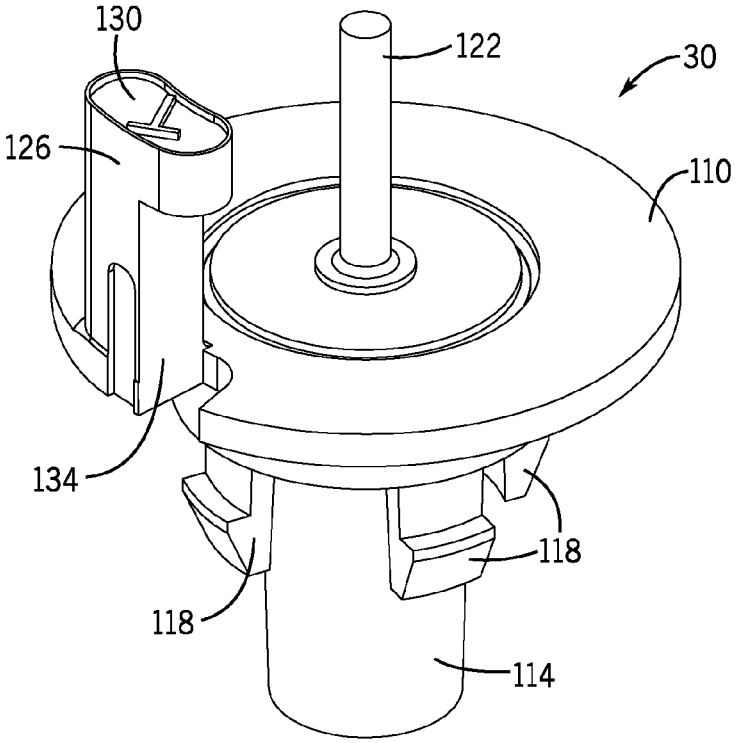
FIG. 13 is another top perspective view of the reset flag of FIG. 12.
Figure 14:
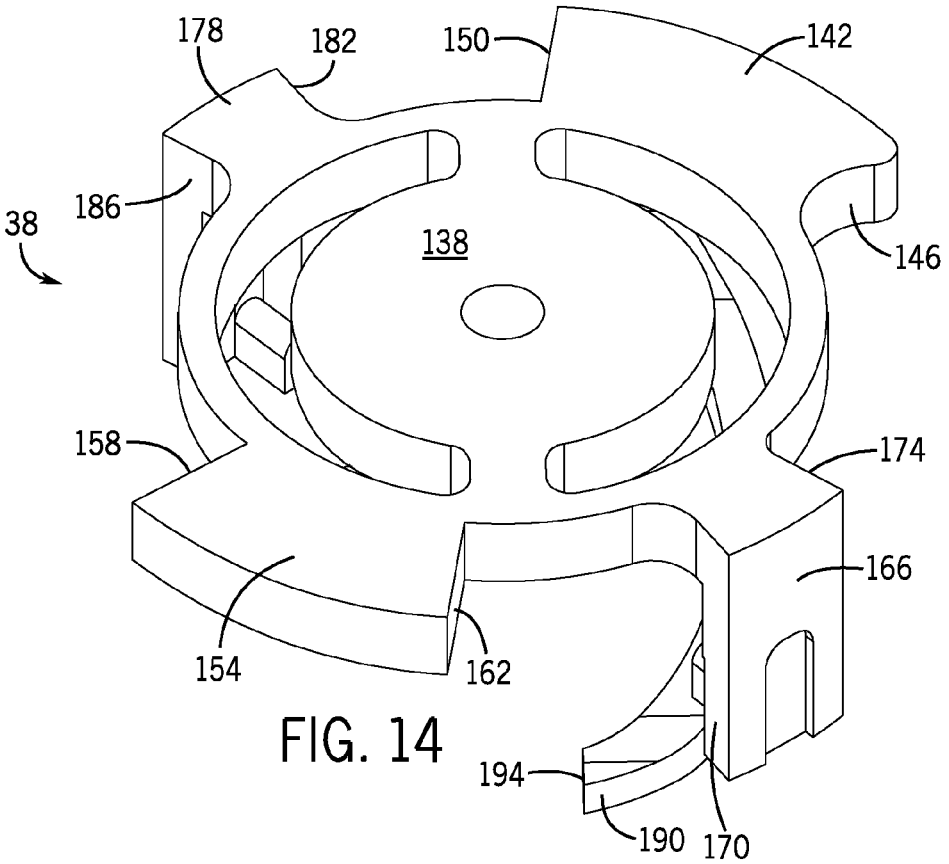
FIG. 14 is a top perspective view of a latching mechanism of the switch assembly of FIG. 1.
Figure 15:
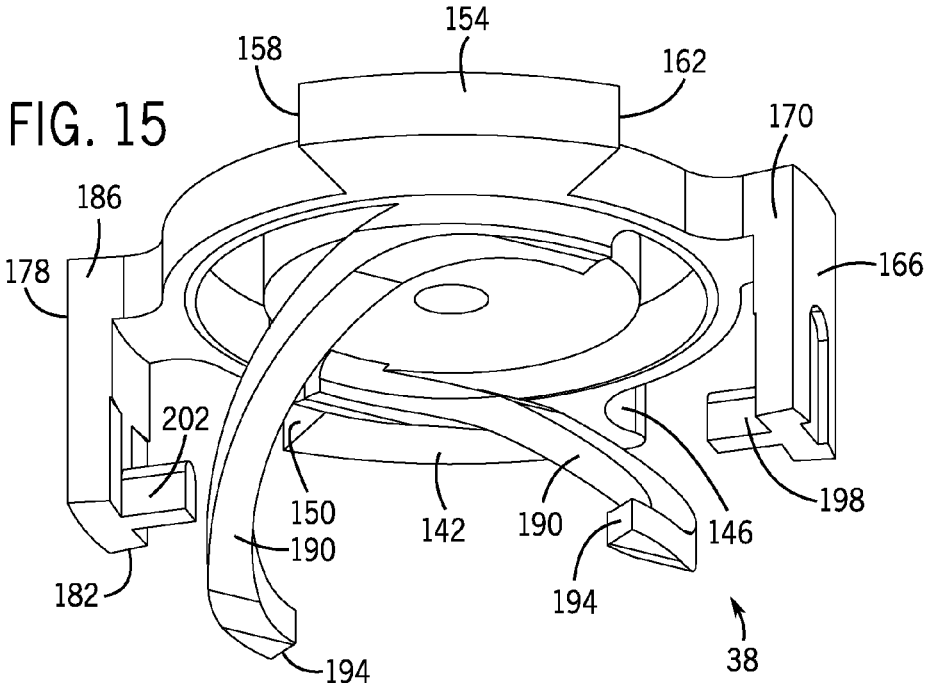
FIG. 15 is a bottom perspective view of the latching mechanism of FIG. 14.
Figure 16:
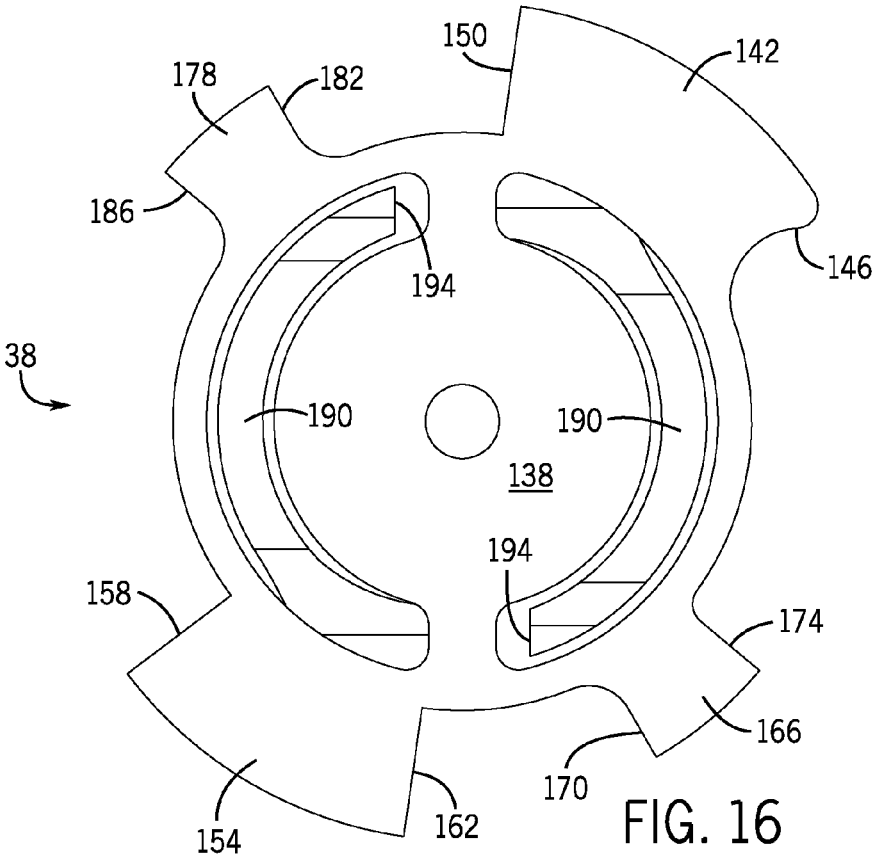
FIG. 16 is a top view of the latching mechanism of FIG. 14.
Figure 17:
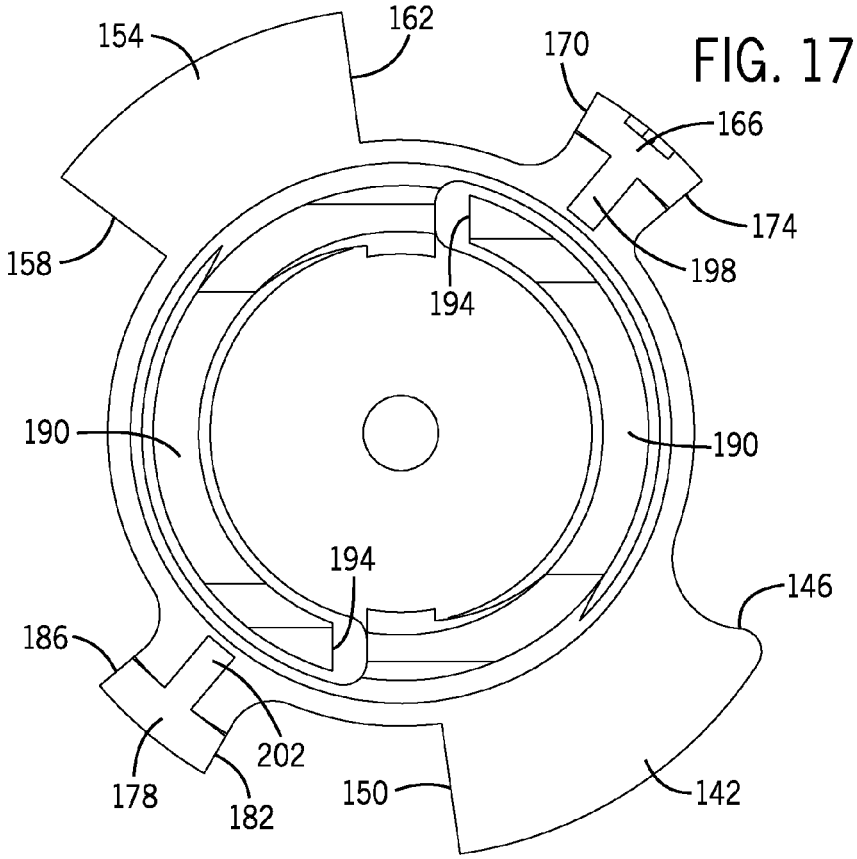
FIG. 17 is a bottom view of the latching mechanism of FIG. 14.

With reference to FIGS. 12 and 13, the reset flag 30 includes a generally circular platform 110 arranged to be supported by the enclosure, a hollow shaft 114 that extends into the enclosure 14 through the aperture 15, three engaging elements 118 arranged to engage the aperture 15 of the enclosure 14 and maintain the reset flag 30 therein, a central pole 122 extending upward from the circular platform 110, and a flag 126. The flag 126 defines an indication surface 130 that may be brightly colored, include text, or other indicating features, as desired. The flag 126 further defines a cut away portion 134.

The interior of the hollow shaft 114 is shaped to matingly receive the coupling feature of the disconnect handle shaft 26. In the present embodiment, the hollow shaft 114 is arranged to engage the two flats 102 and two keyways 106 defined on the shaft 98 of the disconnect handle shaft 26. In other embodiments, the hollow shaft 114 may be received within the coupling feature of the disconnect handle shaft 26 or may not be hollow.

With reference to FIGS. 14-17, the latching mechanism 38 includes an upper surface 138, a first cam 142 defining a clockwise (CW) surface 146 and a counterclockwise (CCW) surface 150, a second cam 154 defining a CW surface 158 and a CCW surface 162, a first arm 166 defining a CW surface 170 and a CCW surface 174, a second arm 178 defining a CW surface 182 and a CCW surface 186, and two biasing elements in the form of living springs 190 depending downwardly from the upper surface 138, each living spring 190 defining an end face 194. The first arm 166 further defines a contact feature in the form of a projection or tab 198 and the second arm 178 further defines a contact feature in the form of a projection or tab 202.

Figure 18:
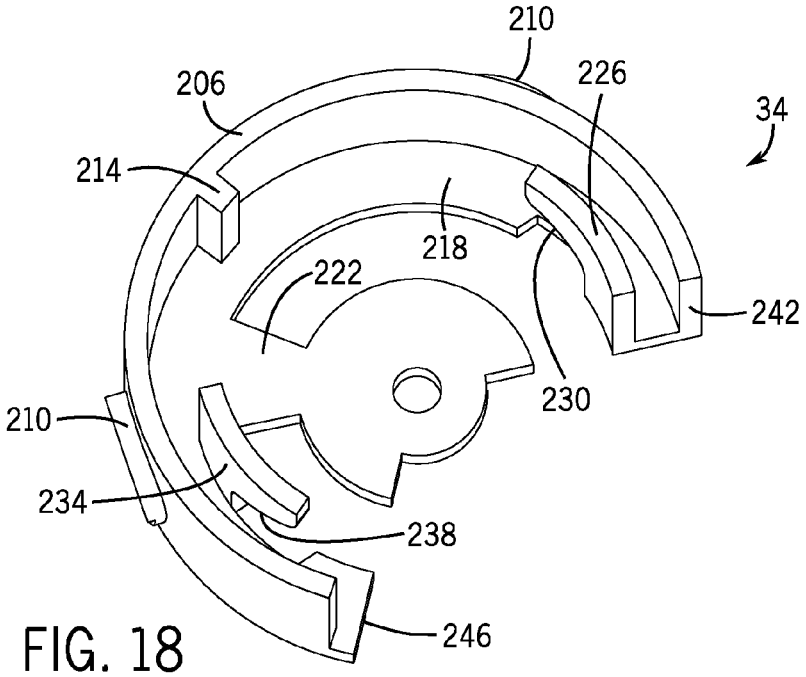
FIG. 18 is a top perspective view of a cam element of the switch assembly of FIG. 1.

With reference to FIGS. 18-20, the cam element 34 includes an outer wall 206 that defines two projections 210 sized to be received within the apertures 17 formed in the wall 16 of the enclosure 14 and a ridge 214 on an interior surface. The cam element 34 also includes a bottom wall 218 configured to rest on top of the circular platform 110 of the reset flag 30 when the switch assembly 10 is installed. The bottom wall 218 defines a stop element 222. A first arm 226 extends upward from the bottom wall 218 and defines a cam surface 230. A second arm 234 extends upward from the bottom wall 218 and defines a cam surface 238. The cam element 34 further defines an OFF surface 242 and an ON surface 246.

Figure 23:
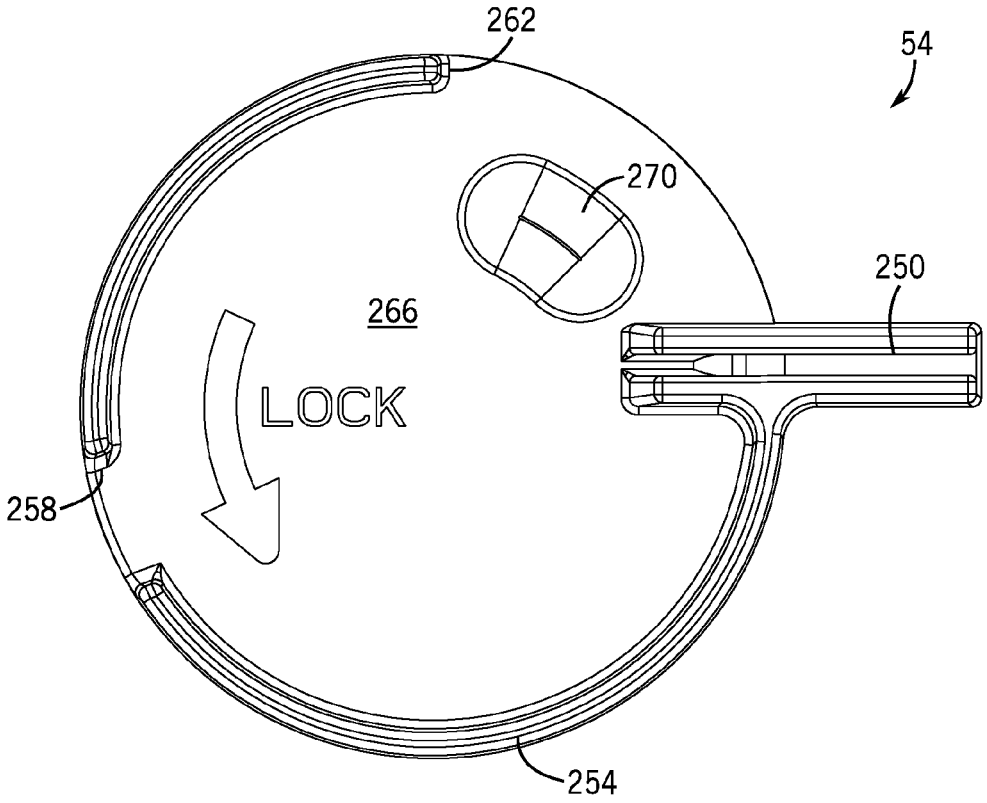
FIG. 23 is a top view of the handle of FIG. 21.

With reference to FIGS. 21-23, the handle 54 includes a hand grip portion 250, an outer wall 254 that defines two tagout channels 258, 262 positioned to cooperate with the apertures 17 of the enclosure 14 for tagging out the disconnect operator 18 in the OFF position. The handle 54 further includes top wall 266 with a window 270 formed therethrough. The window 270 is formed of a clear material that may have magnifying properties. A recess 274 is formed in the handle 54 and arranged to receive the handle seal 50 (e.g., an o-ring) and hold it in place against the sealing surface 78 of the tagout base 46. Four engagement elements 278 are configured to maintain the handle 54 installed within the tagout base 46. The handle seal 50 provides a continuous radial seal, allowing the handle 54 to rotate while maintaining a seal. The base seal 42 and the handle seal 50 cooperate to provide environmental protection that meets the UL50 type 4/IP67/IP69K standard.

Turning to FIG. 22, the handle 54 further includes a first tab 282 formed on the underside of the top wall 266 and defining a CW ramp 286 and a CCW surface 290, a second tab 294 that defines a CW surface 298 and a CCW surface 302, and a third tab 306 that defines a CW surface 310 and a CCW surface 314.

Figure 24:
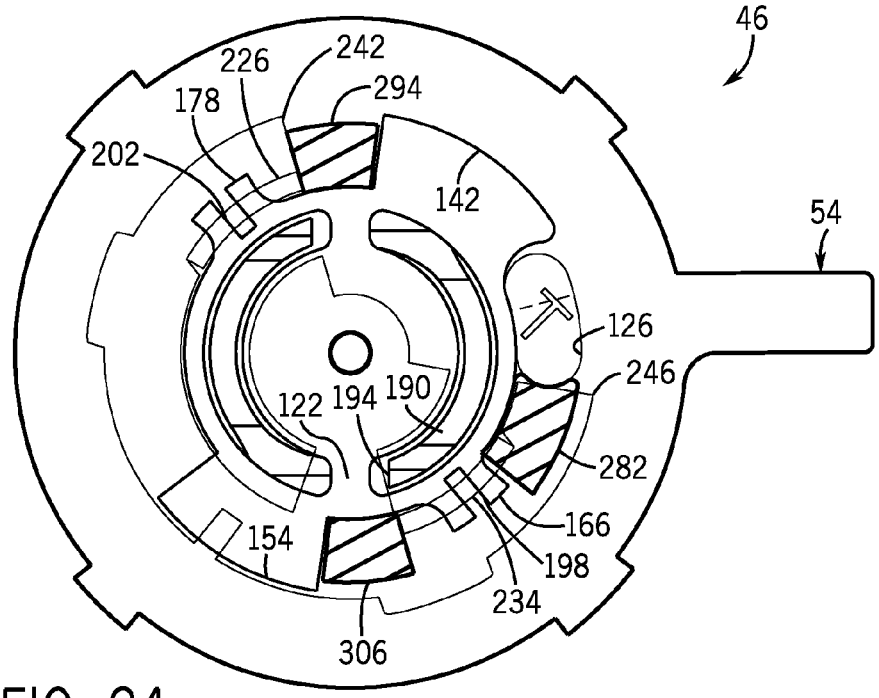
FIG. 24 is a plan view showing the switch assembly of FIG. 1 in an ON position.

Operation of the switch assembly 10 will be discussed below with reference to FIGS. 24-27. Turning particularly to FIG. 24, the disconnect operator 18 is in the ON position and, correspondingly, the switch assembly 10 is in an ON position. When the switch assembly 10 is in the ON position, the disconnect handle shaft 26 is rotated fully CW. As a result, the flag 126 of the reset flag 30 is rotated CW until the flag 126 abuts the ON surface 246 of the cam element 34. The flag 30 abuts and holds the CCW surface 290 of the handle's 54 first tab 282 rotated fully CW. When the switch assembly 10 is in the ON position, the tabs 198, 202 of the latching mechanism 38 are engaged with the cam surfaces 230, 238 of the cam element 34 such that the upper surface 138 of the latching mechanism 38 is forced downward out of engagement with the tabs 282, 294, 306 of the handle 54. Additionally, the end face 194 one living spring 190 abuts the stop element 222 of the cam element 34.

Figure 25:
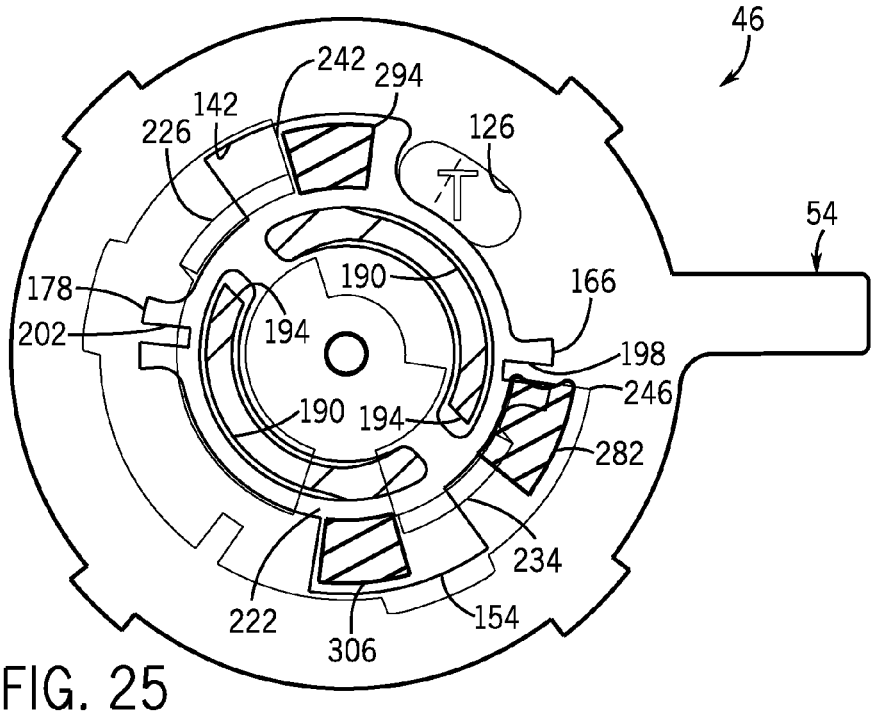
FIG. 25 is a plan view showing the switch assembly of FIG. 1 in a TRIPPED position.

Turning to FIG. 25, the switch assembly 10 is shown in a TRIPPED position. When the disconnect operator 18 moves from the ON position to the TRIPPED position, switch 22 rotates forty-five degrees) (45°) CCW. The flag 126 is likewise rotated CCW forty-five degrees) (45°) and rotates the latching mechanism 38 therewith by abutting the CW surface 146 of the first cam 142. The CCW rotation of the latching mechanism 38 frees the tabs 198, 202 from the cam surfaces 230, 238 of the cam element 34 and the living springs 190 bias the upper surface 138 upward toward the handle 54. In moving from the ON position to the TRIPPED position, the handle 54 does not move. However, a user is given a clear indication that the disconnect operator 18 is in the TRIPPED position via the indicator surface 130 of the flag 126 showing clearly through the window 270 of the handle 54.

Figure 26:
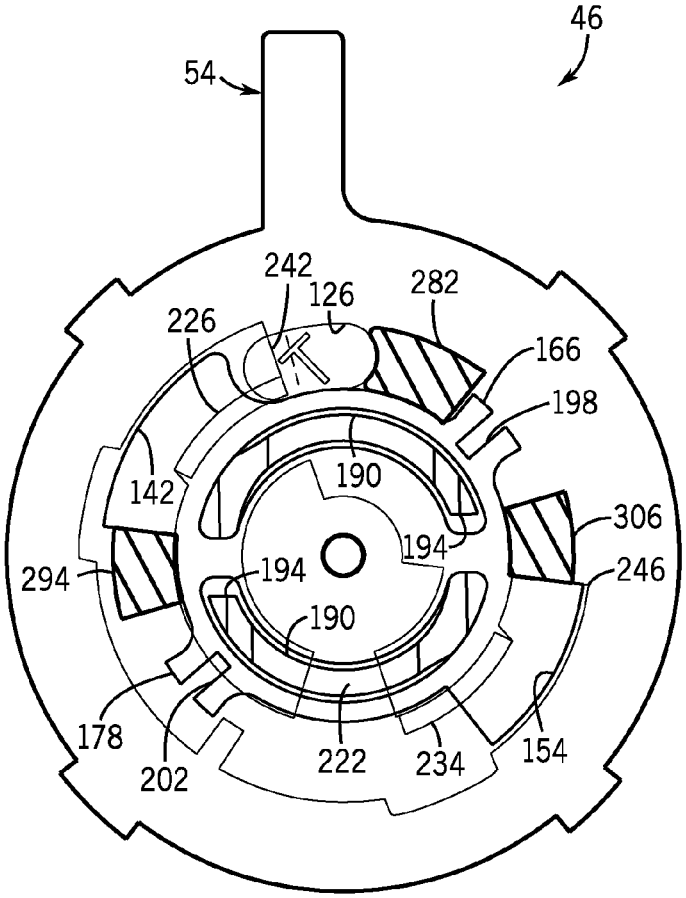
FIG. 26 is a plan view showing the switch assembly of FIG. 1 in an OFF position.

Turning to FIG. 26, the switch assembly 10 is shown in an OFF position. After the disconnect operator 18 has moved to the TRIPPED position, it must be forced into the OFF position before it can be reset to the ON position. To move the disconnect operator 18 to the OFF position, the handle 54 is rotated CCW ninety degrees (90°). The handle 54 rotates freely for the first forty-five degrees (45°) until the first tab 282 abuts the flag 126. Further CCW rotation of the handle 54 forces the flag 126 to the position shown in FIG. 26 wherein the flag 126 is fully rotated CCW and the cut away portion 134 abuts the OFF surface 242 of the cam element 34. The rotation of the flag 126 forces the latching mechanism 38 to continue rotating to the position shown in FIG. 26 wherein the cams 142, 154 and arms 166, 178 are no longer positioned directly underneath the tabs 282, 294, 302 of the handle 54 and the living springs 190 bias the upper surface 138 upward into the same plane as the tabs 282, 294, 302.

Figure 27:
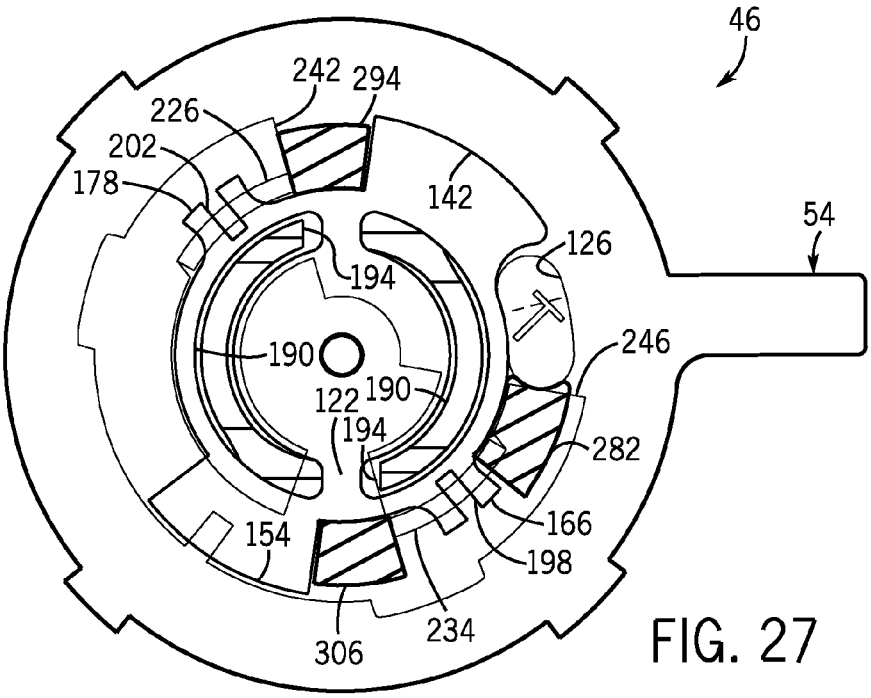
FIG. 27 is a plan view showing the switch assembly of FIG. 1 in a RESET position.

Turning to FIG. 27, the switch assembly 10 is shown in a RESET position in which the components are in the same positions as in the ON position. After the disconnect operator 18 is moved to the OFF position, it may be reset to the ON position. With the tabs 282, 294, 302 of the handle 54, the flag 126, and the cams 142, 154 of the latching mechanism 38 engaged and the tabs 198, 202 of the latching mechanism 38 removed from the cam surfaces 230, 238 of the cam element 34, the handle 54 is rotated CW ninety degrees (90°) such that the second tab 294 pushes on the CCW surface 150 of the latching mechanism's 38 first cam 142, the third tab 306 pushes on the CCW surface 162 of the latching mechanism's 38 second cam 154, and the CW surface 146 of the first cam 142 pushes on the flag 126. In this way, the switching assembly 10 moved back into the ON position, or, in this case, the RESET position. While the latching mechanism 38 is being rotated, the tabs 198, 202 reengage the cam surfaces 230 238 of the cam element 34 such that the upper surface 138 of the latching mechanism 38 is again lowered below the plane of the tabs 282, 294, 302 against the bias of the living springs 190.

The invention offers several advantages. First, the switch assembly 10 may be assembled without k-seals, sealing grease and still maintain a UL50 type 4/IP67/IP69K standard rating. Second, the switch assembly 10 is assembled via snap fit to trap the internal components without the use of screws, staking, sealing greases, springs, or any other mechanical fastening methods. Third, the switch assembly 10 can be turned off, reset, and turned back on while maintaining the required environmental seal. Fourth, by using the indicator surface 130 visible through the window 270, the switching assembly 10 provides a user with a clear indication that the disconnect operator 18 is in the TRIPPED position while maintaining the required environmental seal. Fifth, because the handle 54 does not move when the disconnect operator 18 moves from the ON position to the TRIPPED position, there is very little resistance to movement of the disconnect operator 18 or the components that indicate a tripped state. The components that indicate a tripped state provide an indication of a tripped disconnect operator 18 substantially instantly. In other words, the spring force of the disconnect operator's 18 switch 22 operates the trip mechanism (e.g., the indication surface 130 of the flag 126 and the window 270) of the switch assembly 10 freely. Sixth, the switch assembly 10 provides a lockout tagout ability while maintaining the required environmental seal.

Other embodiments are possible in view of the following claims.

I claim:

1. A sealed switch assembly for use with a disconnect operator movable between an on state, a tripped state, and an off state, the disconnect operator housed within a sealed enclosure, the switch assembly comprising:

a housing sealed to the enclosure to inhibit ingress of solids and liquids therebetween, the housing including tagout apertures;

a handle coupled to the disconnect operator and disposed at least partially within the housing, the handle sealed to the housing to inhibit ingress of solids and liquids therebetween, the handle moveable between an on position and an off position, wherein the handle does not move when the disconnect operator switches from the on state to the tripped state, the handle including tagout channels positioned to cooperate with the tagout apertures of the housing when the handle is in the off position; and a low-friction trip indicator mechanism that operates independent of the handle to indicate when the disconnect operator is in the tripped state.

2. The switch assembly of claim 1, wherein the switch assembly further comprises a base seal and a handle seal that cooperate to provide environmental protection by preventing the ingress of solids and liquids to meet a UL50 type 4/IP67/IP69K standard.

3. The switch assembly of claim 1, wherein the housing is sealed to the enclosure with an o-ring.

4. The switch assembly of claim 1, wherein the handle rotates between the on position and the off position.

5. The switch assembly of claim 1, wherein the handle is sealed to the housing with an o-ring.

6. The switch assembly of claim 1, wherein the low-friction trip indicator mechanism includes a flag coupled to the disconnect operator and that moves in response to the disconnect operator switching between the on state and the tripped state.

7. The switch assembly of claim 6, wherein the the handle further includes a window, the flag of the low-friction trip indicator mechanism is only visible through the window when the disconnect operator is in the tripped state.

8. The switch assembly of claim 1, wherein the handle is operable to actuate the disconnect operator to the off state and the on state.

9. The switch assembly of claim 1, wherein the disconnect operator includes a switch that rotates about forty-five degrees when the disconnect operator actuates between the on state and the off state, and wherein the low-friction trip indicator mechanism is operable to indicate that the switch has rotated.

10. A sealed switch assembly for use with a disconnect operator movable between an on state, a tripped state, and an off state, the disconnect operator housed within a sealed enclosure, the switch assembly comprising:

a handle coupled to the disconnect operator and movable between an on position and an off position, the handle defining lockout tagout channels to permit lockout tagout of the handle in the off position;

a lockout tagout housing that includes lockout tagout apertures positioned to cooperate with the lockout tagout channels of the handle when the handle is in the off position;

an indicator that indicates when the disconnect operator is in the tripped state; and a latching mechanism coupled between the handle and the disconnect operator such that when the disconnect operator actuates from the on state to the tripped state, the handle does not move.

11. The switch assembly of claim 10, wherein the latching mechanism is coupled such that when the disconnect operator is in the tripped state, the handle must be moved to the off position before the disconnect operator can be actuated to the on state.

12. The switch assembly of claim 10, wherein the indicator includes a flag and the handle includes a window through which the flag is only visible when the disconnect operator is in the tripped state.

13. The switch assembly of claim 10, wherein the latching mechanism interacts with the indicator.

14. The switch assembly of claim 10, further comprising an o-ring positioned between the lockout tagout housing and the enclosure to inhibit ingress of environmental elements and an o-ring positioned between the lockout tagout housing and the handle to inhibit ingress of environmental elements.

15. The switch assembly of claim 10, wherein the indicator is actuated by the disconnect operator without assistance.

16. The switch assembly of claim 10, wherein the disconnect operator includes a switch that rotates about forty-five degrees when the disconnect operator actuates between the on state and the off state, and wherein the indicator is operable to indicate that the switch has rotated.

17. The switch assembly of claim 10, wherein the switch assembly further comprises a base seal and a handle seal that cooperate to provide environmental protection by preventing the ingress of solids and liquids to meet a UL50 type 4/IP67/IP69K standard.

* * * * *